US007048465B2

(12) United States Patent
Walters

(10) Patent No.: US 7,048,465 B2
(45) Date of Patent: May 23, 2006

(54) METHOD OF ROUTING AND DIVERTING TRAFFIC

(76) Inventor: Kevin S. Walters, 518 Eastern Avenue, Toronto, Ontario (CA) M4M 1C7

( * ) Notice: Subject to any disclaimer, the term of this patent is extended or adjusted under 35 U.S.C. 154(b) by 0 days.

(21) Appl. No.: 09/897,921

(22) Filed: Jul. 5, 2001

(65) Prior Publication Data

US 2002/0003986 A1 Jan. 10, 2002

Related U.S. Application Data

(60) Provisional application No. 60/216,333, filed on Jul. 5, 2000.

(51) Int. Cl.
*E01C 1/00* (2006.01)

(52) U.S. Cl. ..... 404/1; 404/72

(58) Field of Classification Search ..... 14/2.6, 14/27; 404/1, 72

See application file for complete search history.

(56) References Cited

U.S. PATENT DOCUMENTS 1,852,338 A * 4/1932 Shaffer ..... 14/27
3,208,087 A * 9/1965 Edwards ..... 14/2.6
3,499,179 A * 3/1970 Weld ..... 114/267
3,847,496 A * 11/1974 Stankiewicz ..... 404/1
4,487,151 A 12/1984 Deiana
4,662,019 A * 5/1987 Muller ..... 14/18
4,927,288 A * 5/1990 Raswant ..... 14/78
5,216,773 A * 6/1993 Haakonsen ..... 14/2.6
5,967,694 A 10/1999 Covarrubias et al.

OTHER PUBLICATIONS

Wright and Ashford, 'Transportation Engineering, Planning and Design,' 1989, pp. 399-409.*
Map of Lake Pontchartrain, Louisiana and surrounding areas.*
Glenwood Canyon: Map of Features, map of Interstate 70 through Glenwood Canyon, Colorado.*
Map of northwestern Colorado, including Interstate 70 through Glenwood Canyon.*
Map of Madison, Wisconsin including Monona Bay.*

* cited by examiner

*Primary Examiner*—Gary S. Hartmann
(74) *Attorney, Agent, or Firm*—Bereskin & Parr

(57) ABSTRACT

This invention relates to routing or directing at least a portion of traffic from a tract of land, and particularly to land adjacent a body of water. The method of routing of diverting traffic comprises first identifying a tract of land where a road is needed and identifying an area spaced from the tract of land suitable for supporting the road. The road is then located through the area to span the tract of land. In a preferred embodiment, the road is located offshore from the tract of land, and linked to the road at either end of the tract of land.

6 Claims, 1 Drawing Sheet

METHOD OF ROUTING AND DIVERTING TRAFFIC

FIELD OF THE INVENTION

Figure 1:
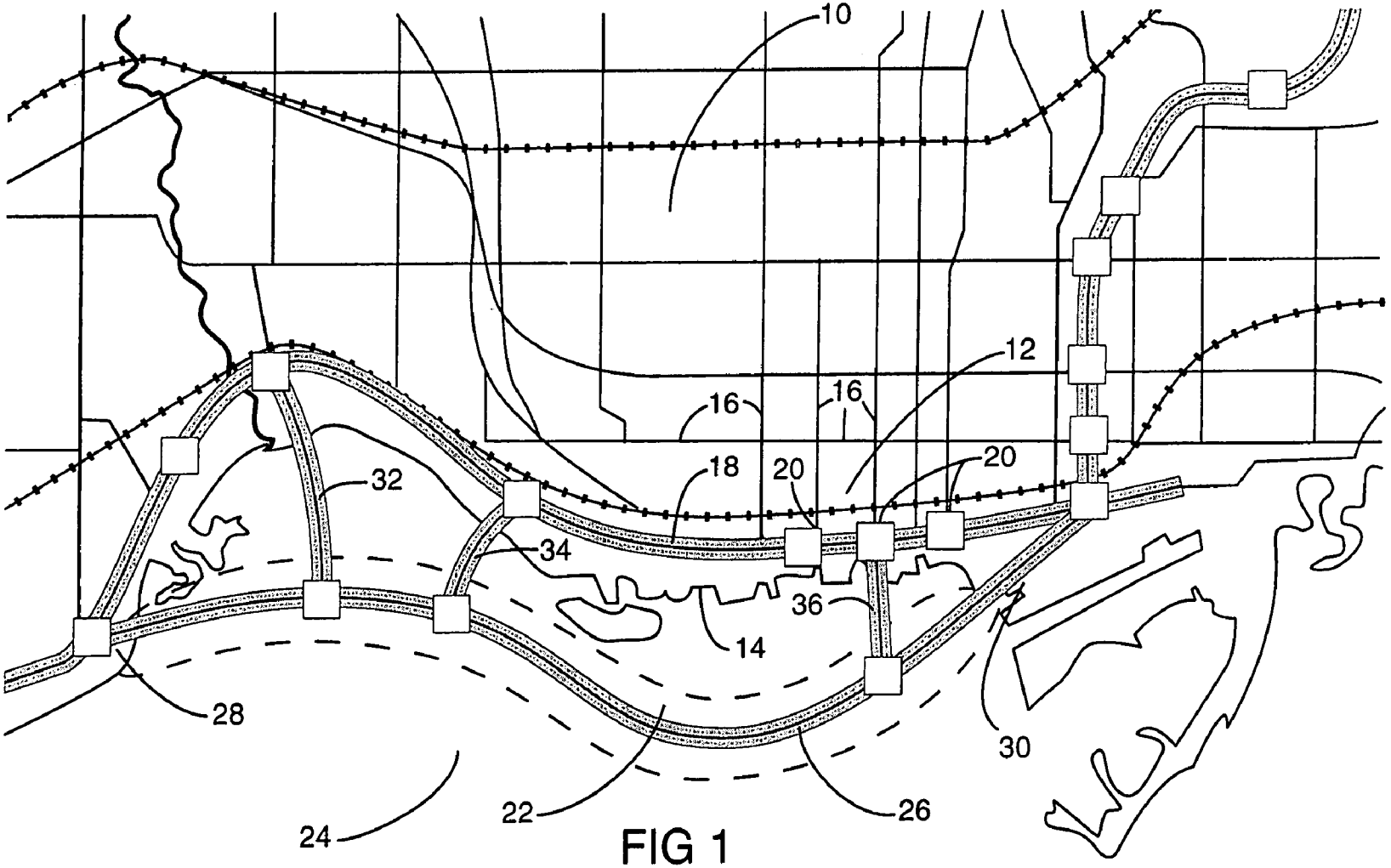

This invention relates to a method of routing or diverting traffic. Moreover, this invention relates to a method of routing or diverting at least a portion of traffic from a tract of land adjacent a body of water. This invention also relates to a method of at least partially freeing a waterfront of traffic.

BACKGROUND OF THE INVENTION

One problem that urban planners can face is where to locate roads leading into, for example, a city core where traffic volume can be heavy. For example, it is not uncommon to provide a road, such as a highway, through or across the city core (often elevated above the city ground). The on and off ramps of such roads, however, can become bottlenecks to traffic flow—particularly at peak hours of usage, such as, for example, morning and evening rush hours.

Moreover, it is not uncommon for urban centres to be located near a body of water, such as, for example, a river, or lake, or other like body of water. Providing a road, such as a highway, through the city core often means running the road through the city's waterfront area. This can lessen the visual impact of the waterfront area. Moreover, the road can have a negative environmental impact on the waterfront area as well.

SUMMARY OF THE INVENTION

This invention is directed to a method of routing or diverting traffic. This invention is also directed to a method of diverting at least a portion of traffic from a tract of land adjacent a body of water. Moreover, this invention is directed to a method of at least partially freeing a waterfront of traffic. As used herein, "traffic" is defined as vehicular movement which includes, but is not limited to, automobiles and trains.

The method of routing of diverting traffic comprises first identifying a tract of land where a road is needed. It can be appreciated that the term road as used in this application can include any way or course for the passage of traffic, such as, for example, an expressway or highway, but is not intended to be limited to these examples. The tract of land can be any land where there is a need for a road, for example, an urban location, such as a city core or waterfront, where a high volume of traffic can occur. It can be appreciated, however, that the tract of land can include other locations such as, for example, rural or farm areas, and provincial parks or beaches, where a road is needed but, for example, the visual or environmental impact of the road on the land is not desired or is to be minimized.

The method also comprises identifying an area spaced from the tract of land suitable for supporting the road. In a preferred embodiment of the invention the area extends generally parallel to the tract of land. Moreover, in a preferred embodiment of the invention the area encompasses at least a portion of a body of water.

The road is then located through the area to span the tract of land. Moreover, the road is linked to either end of the tract of land that the road spans. It can be appreciated, however, that the road can link to the tract of land at at least one intermediate location of the road and the tract of land.

In a preferred embodiment of the invention where the area encompasses at least a portion of a body of water, the road is generally parallel to a shoreline of the body of water and the tract of land.

The road can be constructed using a variety of configurations and styles, for example—but not limited to—a bridge or a floating road or highway, or other suitable structures that can support traffic.

A method of routing or diverting at least a portion of traffic from a tract of land adjacent a body of water is disclosed. In particular, the method comprises locating a road offshore from the tract of land, and linking the road to either end of the tract of land. Further, the road can be linked to the tract of land at at least one intermediate location of the road and the tract of land. Moreover, in a preferred embodiment, the road is parallel to a shoreline of the body of water and the tract of land.

A method of freeing a waterfront from traffic is also disclosed. In particular, the method comprises locating a road offshore from the waterfront, and linking the road to either end of the waterfront. The road can be linked to the waterfront at at least one intermediate location of the road and the tract of land. Moreover, in a preferred embodiment, the road is parallel to a shoreline of the waterfront.

BRIEF DESCRIPTION OF THE DRAWING FIGURE

For a better understanding of the present invention and to show more clearly how it would be carried into effect, reference will now be made, by way of example, to the accompanying drawing showing one preferred embodiment of the present invention, and in which:

FIG. 1 is a plan view of a tract of land, and a road located offshore from the land in accordance with this invention.

DESCRIPTION OF THE PREFERRED EMBODIMENT

FIG. 1 illustrates, by way of example, a tract of land 10 where a road is needed or desired. It can be appreciated that the term road as used in this application can include any way or course for the passage of traffic, such as, for example, an expressway or highway, but is not intended to be limited to these examples. The tract of land 10 as illustrated in FIG. 1 is an urban location, for example, a city core 12 where traffic volume can be heavy. Further, in the example illustrated, city core 12 has a waterfront 14. It can be appreciated, however, that the tract of land can be any land where a road is needed or desired. For example, rural or farm areas, and provincial parks or beaches.

The tract of land 10 illustrated in FIG. 1 includes a number of roads 16 in the city core 12, including road 18, which as illustrated, is a highway that runs along waterfront 14. An arrangement of roads 16 and 18, as illustrated, can give rise to areas of heavy traffic, particularly where on and off ramps are provided, as at 20, for example. Further, these areas can become bottlenecks to traffic flow, particularly at peak hours of usage, such as, for example, morning and evening rush hours.

In accordance with this invention an alternative route is provided to rout or divert at least a portion of the flow of traffic from the tract of land, and particularly, for the example illustrated in FIG. 1, from waterfront 14 of city core 12. Moreover, in certain cases the entire flow of traffic can be routed or diverted from the tract of land. This could have an added benefit of removing certain roads from the tract of land, thereby minimizing the visual or environmental impact that the roads can have on the land.

The alternative route contemplated by this invention is generally provided in an area 22 spaced from the tract of land 10. In the preferred embodiment, and as illustrated in FIG. 1, the area encompasses at least a portion of a body of water 24. Moreover, the area extends generally parallel to the tract of land 10, and, for the example illustrated, runs generally parallel to waterfront 14.

A road 26 is then provided within area 22 to span the tract of land 10, and, in the embodiment illustrated in FIG. 1, the waterfront 14. Road 26 is linked to the tract of land as at 28 and 30, respectively, and preferably at locations representing the ends of the tract of land that traffic is to be, at least partially, routed or diverted around. Road 26 can continue at either end 28 or 30 beyond tract of land 10 using, for example, a conventional road. Alternatively, and as illustrated in the example of FIG. 1, road 26 can link to road 18 at or just beyond ends 28 or 30. Moreover, it can be appreciated, that road 26 can link to the tract of land 10 at at least one intermediate location of the road and the tract of land. For example, in FIG. 1, road 26 is linked to waterfront 14 by appropriate bridges 32, 34, and 36, respectively.

In the embodiment illustrated road 26 runs generally parallel to waterfront 14. In general, area 22 is selected so that any road constructed runs generally parallel to a shoreline of the body of water and the tract of land.

Road 26 can be constructed using a variety of configurations and styles, for example—but not limited to—a bridge or a floating road or highway, or other suitable structures that can support traffic. Moreover, area 22 is generally selected for its suitability to support a road. Considerations for selecting area 22 depend, in part, on the type of road to be built through the area. For example, a bridge would require a stable shelf upon which anchor the bridge supports; a floating road could require consideration of weather patterns and the size of water swells in the area; etc.

It can be appreciated that this invention allows for at least a portion of traffic to be routed or diverted from a tract of land, and particularly by a road located offshore from the tract of land. By routing or diverting traffic offshore, relief can be provided to certain areas of heavy traffic. For the example illustrated in FIG. 1, traffic flow to the on and off ramps, as at 20, in the city core 12, can be reduced, particularly at peak hours of usage, such as, for example, morning and evening rush hours.

Further, by routing or diverting traffic offshore less roads in city core 12 might be needed to handle the traffic flow. This can minimize the visual and environmental impact that the roads can have on the land, and particularly on a waterfront as illustrated in FIG. 1. In its most preferred configuration, enough traffic is routed or diverted offshore through, for example, road 26, that current road 18, as illustrated in FIG. 1, could be eliminated. This could free waterfront 14 of traffic flow.

It can be appreciated that variations to this invention would be readily apparent to those skilled in the art, and this invention is intended to include those alternatives.

I claim:

1. A method of routing traffic, comprising:

(a) identifying a first point and a second point defining ends of an existing route on at least one existing road on a tract of land from where traffic is to be routed;

(b) identifying a body of water proximate to the tract of land, the body of water defining a shoreline along an edge of the tract of land adjacent the body of water, the shoreline having a shoreline length generally spanning the distance between the first and second points, the body of water being suitable for supporting a further road for routing the traffic;

(c) locating the further road through the body of water only to span the tract of land, the further road having a road length generally spanning the distance between the first and second points the further road extending through the body of water generally adjacent to the shoreline so that the further road and the shoreline are generally parallel along their respective lengths, the further road being located above the body of water; and (d) linking the further road to the first point and the second point so that the further road extends only through the body of water to provide an alternate route to the existing route.

2. A method according to claim 1 wherein step d) further comprises linking the further road to the at least one existing road at at least one intermediate location between the first and the second point.

3. A method according to claim 1 wherein the further road is a bridge.

4. A method according to claim 1 wherein the further road is a floating road.

5. A method according to claim 1 wherein the road length of the further road is greater than the existing route between said points.

6. A method according to claim 1 wherein the further road is linked to the first and second points by a first link and a second link, respectively, and wherein the road length of the further road combined with the length of the firs and second links defines an alternate route length, the alternate route length being generally equal to or greater than the length of the existing route between the first and second points.

* * * * *